US005992332A

United States Patent [19]

Grabowski

[11] Patent Number: 5,992,332

[45] Date of Patent: Nov. 30, 1999

[54] ELLIPTICAL WORKSURFACE PROFILE

[75] Inventor: Daniel Grabowski, Grand Rapids, Mich.

[73] Assignee: Steelcase Development Inc., Grand Rapids, Mich.

[21] Appl. No.: 09/017,744

[22] Filed: Feb. 3, 1998

[51] Int. Cl.[6] ..... A47B 57/00

[52] U.S. Cl. ..... 108/64; 108/50.01; 108/27

[58] Field of Search ..... 108/66, 64, 65, 108/27, 50.01, 50.02, 43; D6/421, 422, 423, 441, 487; 312/140.3, 194, 223.3, 238, 195

[56] References Cited

U.S. PATENT DOCUMENTS

D. 134,727 1/1943 Weber .
D. 263,530 3/1982 Liljeqvist .
D. 267,988 2/1983 Crespi .
D. 270,787 10/1983 Umanoff et al. .
D. 270,788 10/1983 Umanoff et al. .
D. 279,846 7/1985 Esslinger .
D. 283,092 3/1986 Johnston .
D. 330,644 11/1992 Bellini et al. .
D. 331,672 12/1992 Brodbeck .
D. 332,189 1/1993 Brodbeck .
D. 332,536 1/1993 Hosoe .
D. 341,507 11/1993 Harvey et al. .
D. 349,824 8/1994 Ball .
D. 352,409 11/1994 Hosoe .
D. 359,405 6/1995 Ball .
D. 367,774 3/1996 Wood, Jr. .
D. 367,970 3/1996 Rhoads .
D. 369,788 5/1996 Yanos et al. .
D. 371,468 7/1996 Sittel et al. .
D. 371,699 7/1996 Muller-Deisig et al. .
D. 371,701 7/1996 Jolly .
D. 372,811 8/1996 Muller-Deisig et al. .
D. 395,969 7/1998 Barlow-Lawson .
3,053,598 9/1962 Cheslow .
3,533,362 10/1970 Thompson .
4,639,049 1/1987 Frascaroli et al. .
4,732,088 3/1988 Koechlin et al. .
5,253,595 10/1993 Heidmann .
5,265,952 11/1993 Greshem et al. .
5,277,130 1/1994 Caporrella ..... 108/64 X
5,339,747 8/1994 Epps .
5,435,254 7/1995 Amey et al. .
5,438,937 8/1995 Ball et al. .
5,451,101 9/1995 Ellison et al. .
5,479,864 1/1996 Kemp ..... 108/27
5,522,323 6/1996 Richard .
5,528,996 6/1996 Edwards et al. .
5,676,068 10/1997 Kallander ..... 108/66 X
5,704,298 1/1998 Corpus, Jr. et al. ..... 108/64 X
5,765,315 6/1998 Nagamitsu et al. ..... 108/50.01 X
5,787,648 8/1998 O'Malley .

*Primary Examiner*—Jose V. Chen
*Attorney, Agent, or Firm*—Price, Heneveld, Cooper, DeWitt & Litton

[57] ABSTRACT

A system of worksurfaces for workstations and the like comprise at least first and second individual worksurfaces adapted to be supported in a generally horizontal orientation at a substantially common height. Each worksurface has a top surface, with an inner edge configured to accommodate a user thereby, and also has lateral edges shaped to abut one another when the first and second worksurfaces are positioned adjacent each other. The inner edges are elliptically contoured wherein the ellipse defined by the inner edges is substantially coplanar with the worksurfaces and is aligned with a horizontal diagonal of the workstation thereby adapting the worksurfaces to particular uses. The inner edges are variably tapered in elevation to be deeply tapered in areas of frequent user interaction and shallowly tapered in areas used primarily for storage and minimal user interaction.

37 Claims, 6 Drawing Sheets

ELLIPTICAL WORKSURFACE PROFILE

BACKGROUND OF THE INVENTION

The present invention relates to worksurfaces, and in particular to a system of worksurfaces for office workstations.

Open office plans are well-known in the art, and generally comprise large, open floor spaces in buildings that are furnished in a manner that is readily reconfigurable to accommodate the ever changing needs of a specific user, as well as the divergent requirements of different tenants. One arrangement commonly used for furnishing open plans includes movable partition panels that are detachably interconnected to partition off the open spaces into individual workstations or offices. Such partition panels are configured to receive hang-on furniture units, such as worksurfaces, overhead cabinets, shelves, etc., and are generally known in the office furniture industry as "Systems Furniture." Another arrangement for dividing or partitioning open plans includes modular furniture arrangements, in which a plurality of differently shaped, freestanding furniture units are interconnected in a side-by-side relationship, with upstanding privacy screens attached to at least some of the furniture units to create individual, distinct workstations, or offices.

Such prior art partitioning arrangements create relatively permanent, multi-function workstations for the users, wherein the workstations are required to support both individual work activities as well as facilitating interpersonal activity in today's highly dynamic and technology based workplace. The worksurfaces incorporated in these workstations are typically comprised of a series of rectilinear worksurfaces arranged about the interior perimeter of the workstation. These worksurfaces may also include one or more worksurfaces having either a circular or polygonal inner edge presented to the user. These worksurfaces are relatively uniform in size and shape which, in the traditional office, was satisfactory for an individual worker whose work activities concentrated on primarily hard copy, paper-based work day activities. However, these types of conventional worksurfaces and worksurface systems are not particularly adapted to support workers engaged in today's electronic office in which the worker has at his disposal and as an integral part of his workstation, computers, dictaphones, communications equipment, and other electronic office appliances in addition to the traditional paper-based aspects of an office. As a result of the varied uses of the worksurfaces in an individual workstation, the worksurfaces employed therein must be adaptable to a number of uses and must do so efficiently. The worksurface elements employed in the workstation must provide the worker with a maximum surface area for supporting the electronic and communications equipment utilized therein while concurrently presenting a user friendly and ergonomic work area for the user to perform the more traditional paper-based aspects of employment.

These varied necessities of the modern work-place require a worksurface configuration in a workstation to incorporate worksurface elements of differing depths to facilitate the requirements of varied worksurface usage. Additionally, the worksurfaces should provide a maximum surface area storage while simultaneously providing ease of user access to those areas of the worksurface used in the paper-based aspects of day-to-day work. These requirements must be satisfied while presenting the user with an ergonomic and aesthetically pleasing environment having a user interface area that continuously transitions from one worksurface capability to another, and thus eliminating discontinuities such as internal corners which tend to be avoided by the user and thus become unusable work space. As building costs continue to escalate, increasing numbers of workers are now being supported in open office settings instead of conventional private offices in order to gain increased efficiency of real estate and life cycle costs. Such efficiency has heretofore not been found in current configurations of worksurfaces utilized in work spaces. Thus, there is a need for a system of worksurfaces providing the worker with a combination of surface storage and user interface areas in an efficient ergonomic setting.

SUMMARY OF THE INVENTION

One aspect of the present invention is a system of worksurfaces for workstations and the like comprising at least first and second individual worksurfaces which are adapted to be supported in a generally horizontal orientation at a substantially common height. Each worksurface has a top surface, with an inner edge configured to accommodate a user thereby, and includes lateral edges shaped to abut one another when the first and second worksurfaces are positioned adjacent each other. The inner edges are elliptically contoured wherein the ellipse defined by the inner edges is substantially coplanar with the worksurfaces and is aligned with a horizontal diagonal of the workstation thereby adapting the worksurfaces to particular uses. The inner edges are also variably tapered in elevation to be deeply tapered in areas of frequent user interaction and shallowly tapered in areas used primarily for storage and minimal user interaction.

Another aspect of the present invention is a system of worksurfaces for workstations and the like comprising at least first and second individual worksurfaces adapted to be supported in a generally horizontal orientation at a substantially common height. Each worksurface has a top surface with an inner edge configured to accommodate a user thereby and also has lateral edges shaped to abut one another when the first and second worksurfaces are positioned adjacent each other. The inner edge of the first worksurface adjacent to and in combination with at least a portion of the inner edge of the second worksurface defines in plan at least a portion of an ellipse. The inner edge of the first worksurface and the inner edge of the second worksurface each define different segments of the ellipse.

Yet another aspect of the present invention is a system of worksurfaces for workstations and the like comprising at least first and second worksurfaces adapted to be supported in a generally horizontal orientation at a substantially common height. Each worksurface has a top surface with at least one outer edge and an inner edge configured to accommodate a user thereby. The worksurfaces also have lateral edges shaped to abut one another when the first and second worksurfaces are positioned adjacent each other. A non-uniform tapered portion is adjacent the inner edge wherein the tapered portion is defined by the inner edge, at least a portion of the lateral edges, and by an arcuately concave boundary defined by an intersection of the tapered portion with the top surface.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
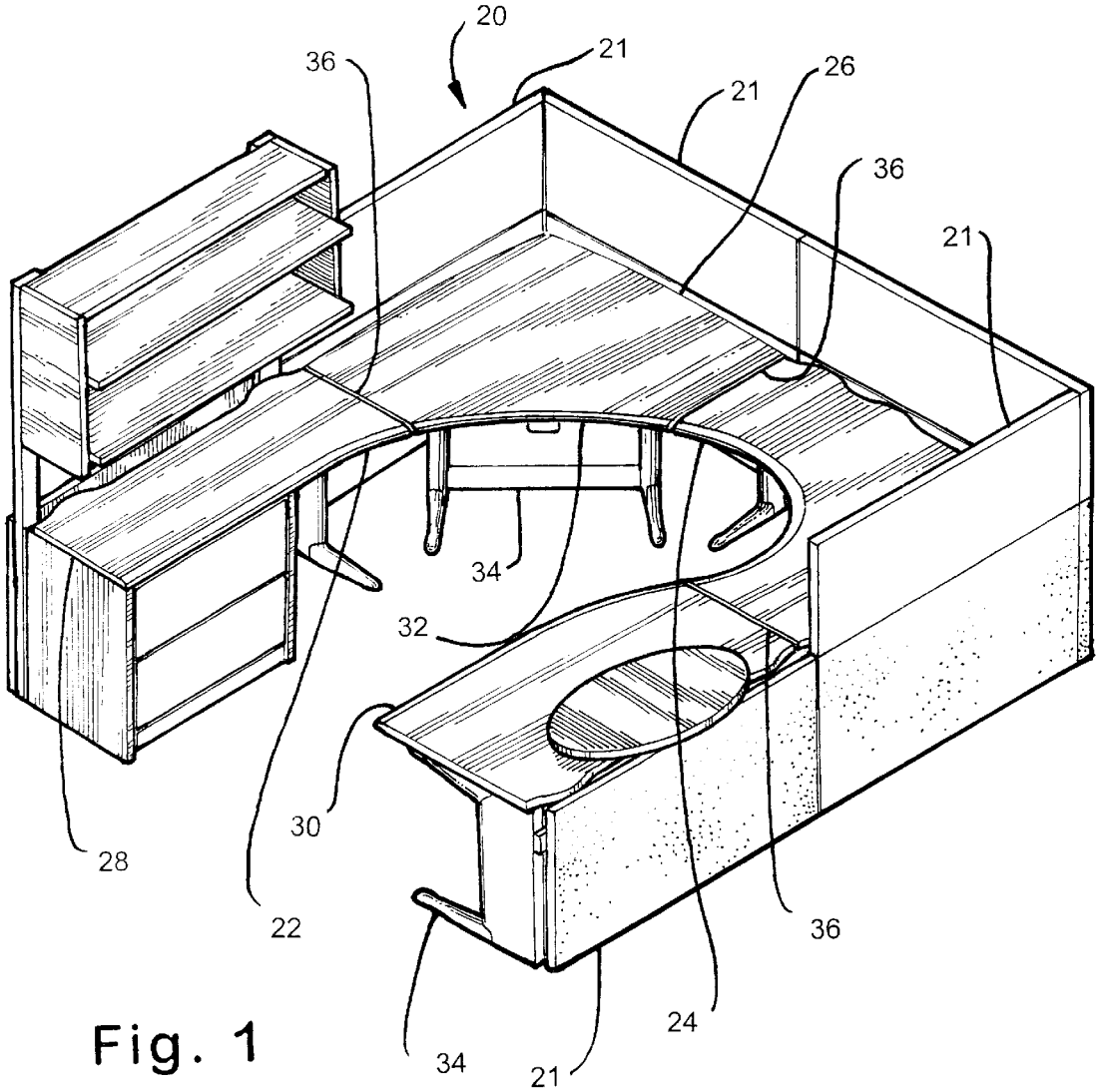
FIG. 1 is a perspective view of a work space embodying worksurfaces of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Turning to the drawings, FIG. 1 shows a work space 20 incorporating a system 22 of worksurface elements, which is one of the preferred embodiments of the present invention, and illustrates its various components and characteristics.

Worksurface system 22, one embodiment of which is more easily seen in FIG. 1, includes a plurality of worksurface elements such as first corner unit 24 and second corner unit 26 which generally provide either singly or in combination the core upon which a particular work space is configured. The final configuration of worksurface system 22 embodied in a work space 20 is determined by the inclusion of one or more accessory worksurface elements such as worksurface elements 28 and 30. When arranged in laterally abutting relationship, a particular embodiment of worksurface system 22 presents a substantially continuous inner edge 32 to provide the worker occupying work space 20 with an efficient and functional work environment. Each individual worksurface element of worksurface system 22 has at least one lateral edge adapted for abutting a lateral edge of an adjacent worksurface at worksurface abutments 36.

Figure 2:
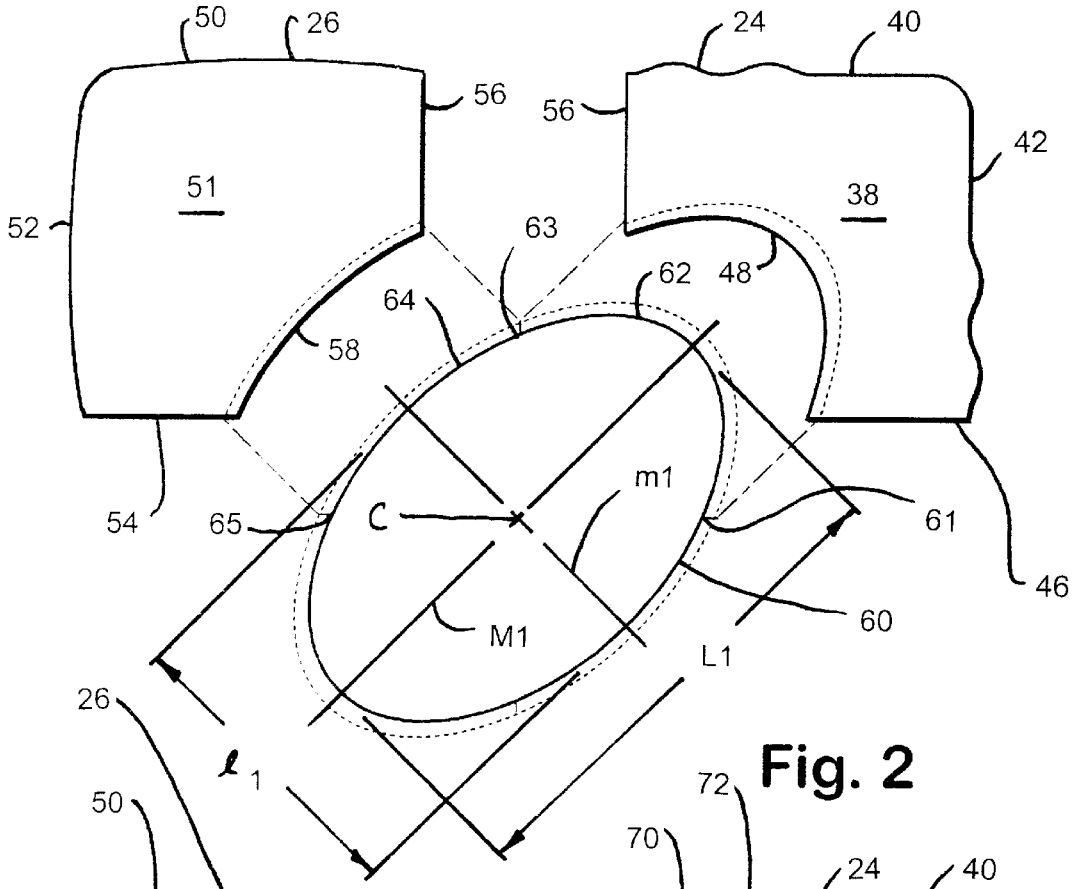
FIG. 2 is a plan view of two worksurface elements illustrating the elliptical planform of the worksurface inner edge.

In the preferred embodiment of worksurface system 22, continuous inner edge 32 is primarily arcuately concave and is based on an elliptical planform. FIG. 2 discloses the elliptical relationship of continuous inner edge 32. As shown in plan, first corner element 24 has outer edges 40 and 42 at substantially right angles one to the other, left lateral edge 44, right lateral edge 46, and inner edge 48 extending between left and right lateral edges 44 and 46. Edges 40, 42, 44, 46, and 48 define the boundaries of top surface 38 of first worksurface element 24. In like manner, second worksurface element 26 has outer edges 50 and 52 at substantially right angles one to the other, left lateral edge 54, right lateral edge 56, and inner edge 58 extending between right and left lateral edges 54 and 56. Edges 50, 52, 54, 56, and 58 define the boundaries of top surface 51 of second corner element 26. In the preferred embodiment, inner edges 48 and 58 are adjoining segments of a common ellipse 60.

In the preferred embodiment, ellipse 60 has a major axis M1 having a length L1 and a minor axis m1 having a length l1. Major axis M1 is oriented substantially at a 45° angle with respect to outer edges 40, 42, 50, and 52 of corner elements 24 and 26, respectively. Additionally, the ratio of major axis length L1 to minor axis length l1 is approximately 1.6:1, although other ratios may be utilized. The elliptical planform of inner edge 48 corresponds to major elliptical segment 62 of ellipse 60. Major elliptical segment 62 is bounded by segment ends 61 and 63 and is centered about major axis M1. Segment ends 61 and 63 are defined by the intersections of horizontal and vertical lines passing through centroid C of ellipse 60. In like manner, the arcuate planform of inner edge 58 of second corner element 26 is defined by minor elliptical segment 64 of ellipse 60 wherein minor elliptical segment 64 is centered about minor axis m1 and is bounded by segment ends 63 and 65 which, in turn, are also determined by the intersection of horizontal and vertical lines passing through centroid C of ellipse 60.

Figure 3:
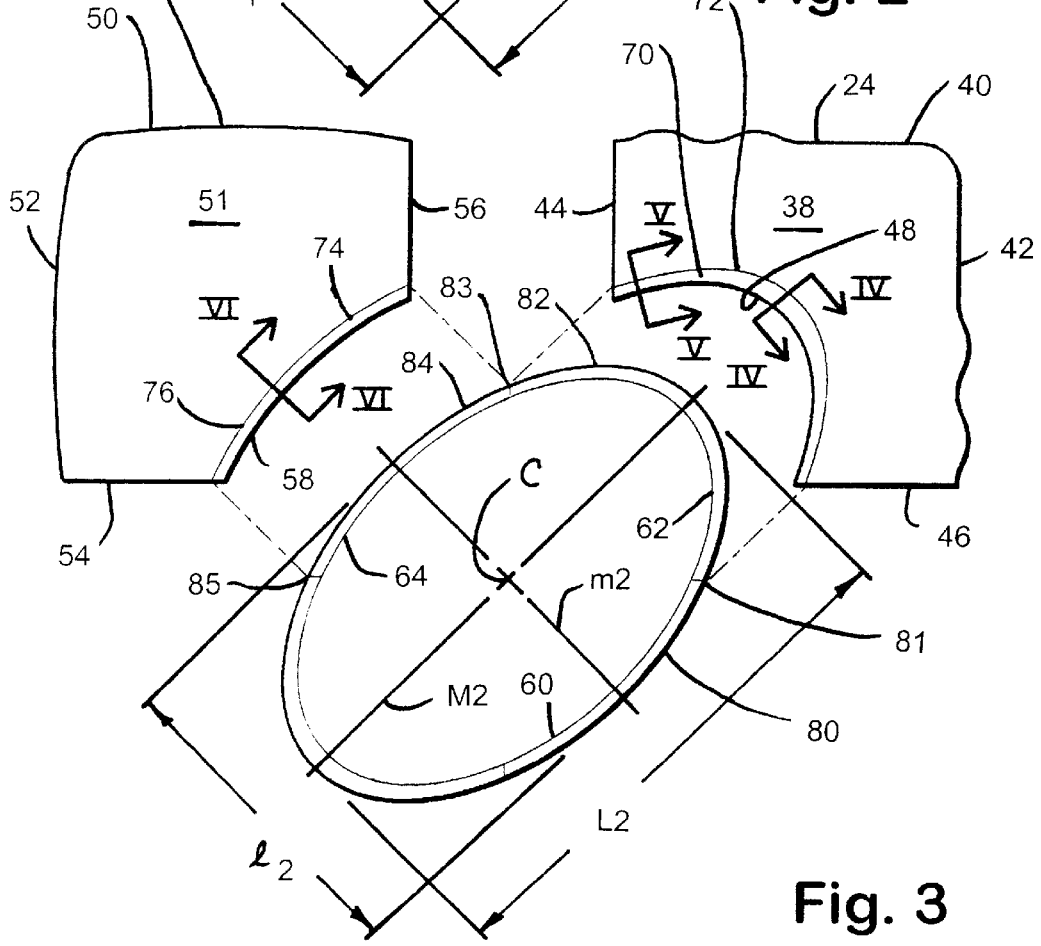
FIG. 3 is a plan view of two worksurface elements illustrating the elliptical relationship of the tapered portion at the worksurfaces' inner edge.

Referring now to FIGS. 3–6, the worksurface elements of worksurface system 22 can also include tapered portions adjacent the inner edges of individual worksurface elements. As shown in FIG. 3, first corner element 24 has a tapered portion 70 adjacent inner edge 48 and second corner element 26 has a tapered portion 74 adjacent inner edge 58. Tapered portion 70 of worksurface element 24 is bounded on one side by inner edge 48 and on the other side by boundary 72. Boundary 72 is defined by the intersection of tapered portion 70 and top surface 38 such that boundary 72 has an elliptical planform. Similarly, boundary 76 of tapered portion 74 of second corner element 26 is defined on one side by inner edge 58 and on the other side by boundary 76. Boundary 76 also has an elliptical planform. The elliptical planform of boundaries 72 and 76 is defined by ellipse 80 which shares centroid C with ellipse 60. Ellipse 80 has major axis M2 and minor axis m2 which are coincident with major axis M1 and minor axis m1 of ellipse 60. The ratio of major axis M2 to minor axis m2 is also approximately 1.6:1. Boundary 72 corresponds to major elliptical segment 82 extending from segment end 81 to segment end 83 which, as in ellipse 60, are defined by the intersection of a vertical line and a horizontal line passing through the centroid C of ellipse 80.

Boundary 76 corresponds to minor elliptical segment 84 which extends from segment end 83 to segment end 85 and is centered about minor axis m2. Ellipses 60 and 80 are concentric.

Figure 4:
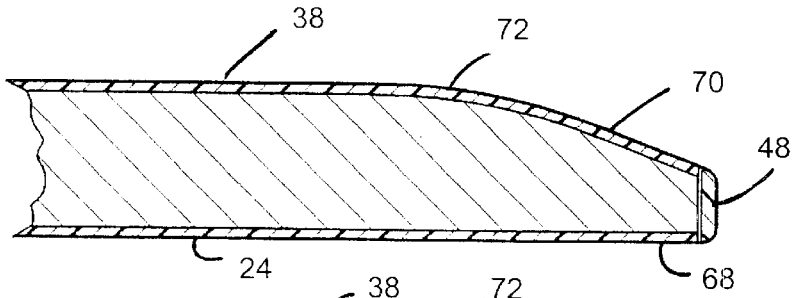
FIG. 4 is a vertical, cross-sectional view of the tapered portion of the worksurface inner edge corresponding to the area about the major axis of the ellipse defining the inner edge.
Figure 5:
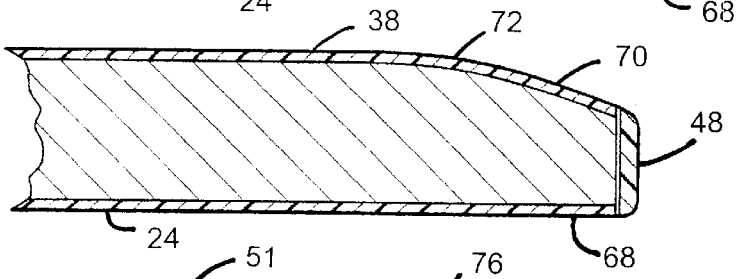
FIG. 5 is a vertical, cross-sectional view of the tapered portion of the worksurface substantially at the abutment of the adjacent worksurface elements.
Figure 6:
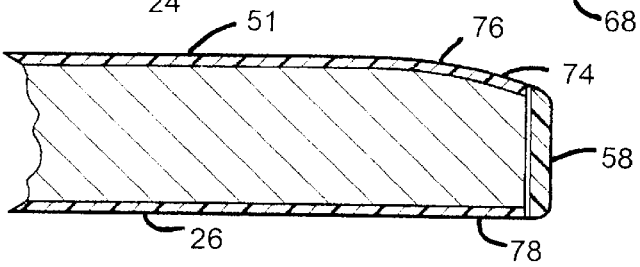
FIG. 6 is a vertical, cross-sectional view of the tapered area of the worksurface inner edge at the minor axis of the ellipse defining the inner edge.

Since ellipses 60 and 80 have approximately the same major to minor axial ratio, the radial width between inner edge 48 and boundary 72 and between inner edge 58 and boundary 76 of corner elements 24 and 26, respectively, is not constant. Consequently, the cross-sectional vertical profile of tapered portions 70 and 74 are non-uniform as shown by FIGS. 4–6. FIG. 4 shows a cross section of tapered portion 70 at the major axis of the concentric ellipses 60 and 80. The slope of tapered portions 70 and 74 are substantially constant, and, in the preferred embodiment, are tapered at approximately an 18° angle with respect to horizontal. At the area of tapered portion 70 corresponding to the major axis of ellipses 60 and 80, the vertical height of edge 48 is a minimum and the distance from edge 48 to boundary 72 is a maximum. Conversely, at minor axis m of ellipses 60 and 80, tapered portion 74 as shown in cross section in FIG. 6 illustrates inner edge 58 as measured from bottom surface 78 to be at a maximum while the distance from edge 58 to boundary 76 is at a minimum. FIG. 5 illustrates a cross section at an intermediate portion and approximately at the abutment of the first and second corner elements 24 and 26. The vertical height of edge 48 as measured from bottom surface 68 is intermediate the height of edge 48 at the major axis and the height of edge 58 at the minor axis. Also, the distance from edge 48 to boundary 72 at the intermediate cross section is also intermediate the distance from edge 48 to boundary 72 at the major axis and from edge 58 to boundary 76 at the minor axis of the ellipses 60 and 80. The relationship of the height of edges 48 and 58 have an inverse proportionality to the corresponding distance from edges 48 to boundaries 72 and 76, respectively.

Figure 7:
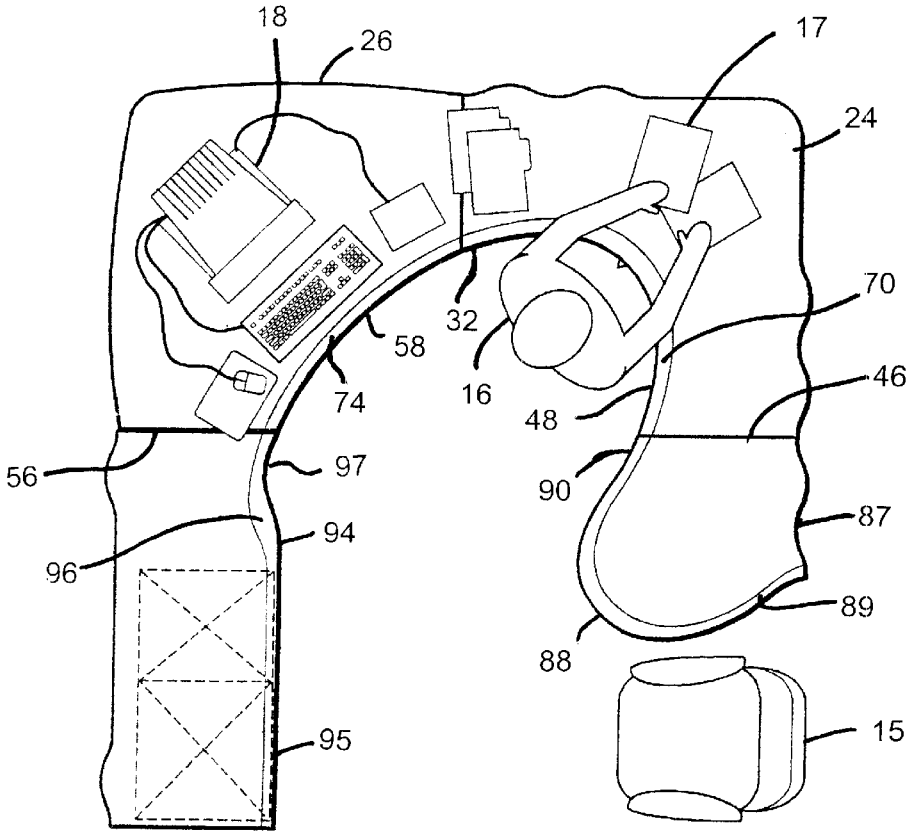
FIG. 7 is a plan view of a plurality of worksurface elements according to the present invention in use by a worker.

Referring again to FIG. 3, first and second corner elements 24 and 26, while related by the definition of tapered portions 70 and 74 of the same ellipses 60 and 80, are also unique one with respect to the other. Each is particularly suited for unique functions of a workstation 20 in which they are positioned. FIG. 7 illustrates an embodiment of a plurality of worksurface elements arranged to populate a work space such as work space 20 (FIG. 1). A worker 16 is shown as seated in front of first corner element 24 which is particularly adapted for use by the worker for performing traditional document handling activities. The elliptical planform segment associated with inner edge 48 provides worker 16 with a wrap-around configuration of first corner element 24 thus facilitating convenient and easy access to all portions of element 24 while seated at element 24. The more deeply cut tapered area 70 as illustrated in FIG. 4 provides an ergonomically favorable interface for the worker's arms while working at element 24. Second corner element 26 is shown with a computer workstation 18 positioned thereon. Computer workstations such as workstation 18 typically have a plurality of elements such as a central processor case, monitor, keyboard, mouse, and mouse pad such that a significant amount of worksurface area is required to support these elements. The elliptical planform about the minor axis of the ellipse for inner edge 58 facilitates the worksurface depth required for an efficient arrangement of such equipment. Worksurface area of element 26 is further maximized by the relatively small tapered area 74 as illustrated in FIG. 6. The arrangement of worksurface elements in the individual work space is completed by the addition of accessory worksurface elements. As shown in FIG. 7, a wing element 87 is shown abutted to the right lateral edge 46 of first corner element 24. Wing element 87 has an inner edge 88 which has an arcuately shaped planform to accommodate a co-worker seated in chair 15 in addition to worker 16 for interpersonal interaction. Wing element 87 also has adjacent to inner edge 88 a tapered portion 89 consistent with tapered portions 70 and 74 as described above. Tapered portion 89 has an end portion 90 having an arcuate planform, the end portion of which is arcuately tangent to the elliptical planform of inner edge 48 and tapered portion 70. A first linear element 94 is abutted to left linear edge 56 of second corner element 26. First linear element 94 has an inner edge 95 which is primarily linear and has adjacent thereto tapered portion 96 which is consistent with tapered portion 74 of second corner element 26. First linear element 94 has an end portion 97 which has an arcuate planform which at its very end is tangential to the elliptical planform of inner edge 58 and tapered portion 74. The combination of abutted worksurface elements 24, 26, 87, and 94 present to the worker therein a continuous and unbroken inner edge 32 wherein the varying arcuate planform adapts the worksurface system 22 to specific work functions to be performed by worker 16.

Figure 8:
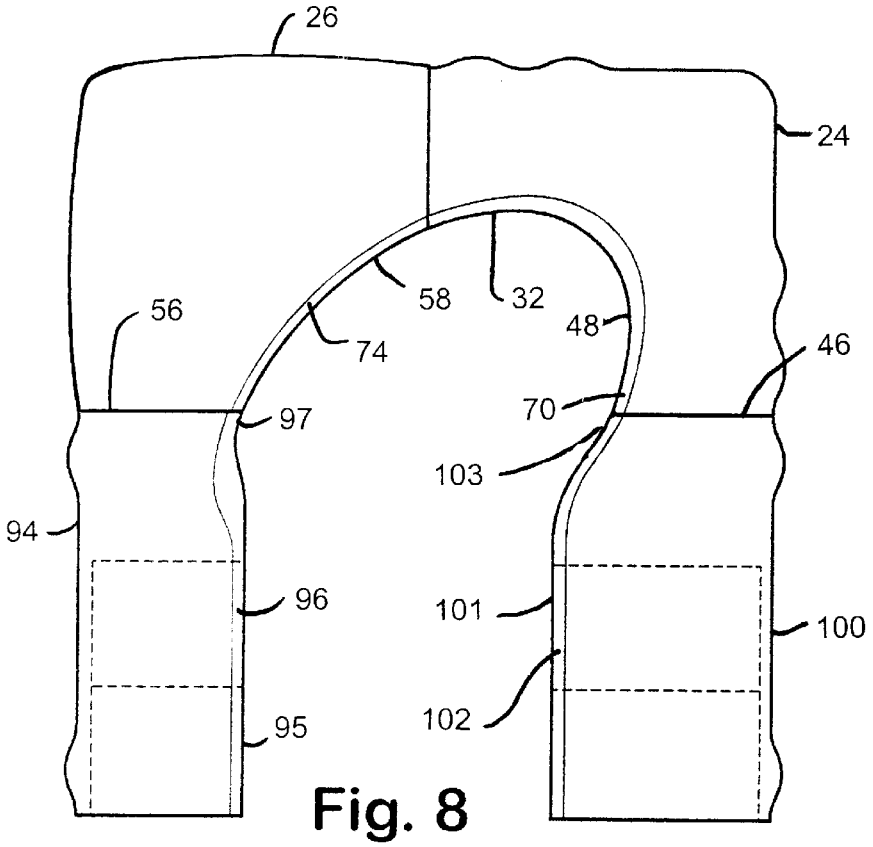
FIG. 8 is a plan view of an alternate combination of worksurface elements according to the present invention.

FIG. 8 illustrates a variation of the worksurface arrangement as shown in FIG. 7 wherein wing element 87 is replaced by second linear element 100. Second linear element 100 is similar in construction and planform to first linear element 94 wherein the inner edge 101 is primarily linear and has associated therewith a tapered portion 102 and has at the end abutting right linear edge 46 of corner element 24 an arcuate end 103 thereof which in planform is tangent to inner edge 48 and tapered portion 70 of corner element 24. Arcuate end 97 of first linear element 94 and arcuate end 103 of second linear element 100 facilitate the incorporation of narrow worksurface elements such as element 94 or relatively wide worksurface elements such as linear element 100 without detracting from the continuous unbroken nature of continuous inner edge 32.

Figure 9:
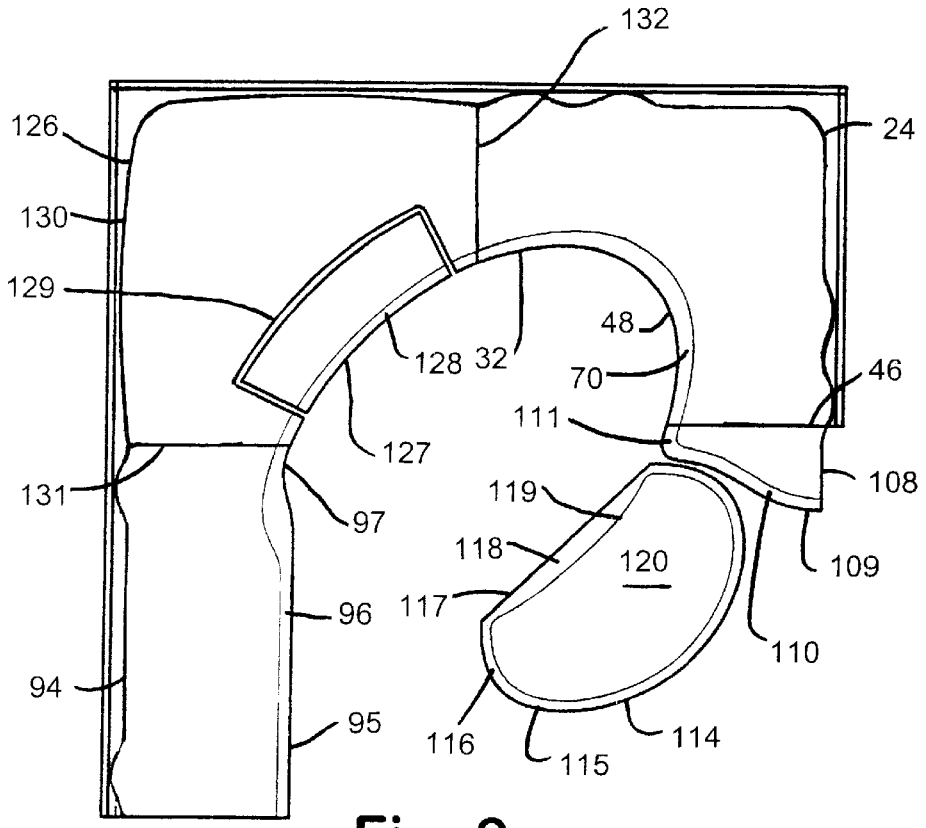
FIG. 9 is a combination of worksurface elements according to the present invention in which one of the elements has a separate vertically adjustable surface and a movable surface has an alternate embodiment of the tapered edge.

FIG. 9 shows yet another embodiment of a configuration of worksurface elements similar to the configuration as disclosed in FIG. 8. In the configuration of FIG. 9, second linear element 100 is replaced by end cap 108 having an exterior edge 109 and tapered portion 110 adjacent thereto. End cap 108 abuts against right lateral edge 46 of corner element 24 and provides an aesthetically pleasing end treatment presenting and facilitating the nature of the continuous inner edge 32. End cap 108 has an end portion of exterior edge 109 and tapered portion 110 which is arcuately tangential to inner edge 48 and tapered portion 70 of corner element 24. The relatively small size of end cap 108 facilitates the addition of movable worksurface 114 which can be supported on a framework readily movable by a user thereof. Movable worksurface 114 has an exterior edge 115 and a tapered portion 116 extending around the circumference of movable worksurface 114. Exterior edge 115 has a portion 117 thereof which can be linear and also has associated therewith a tapered segment 118 having an upper boundary 119 defined by the intersection of tapered segment 118 and top surface 120 of movable worksurface 114. Tapered segment 118 is contoured such that boundary 119 is elliptically arcuate and vertical thickness of edge 117 varies therealong in a manner similar to the varying height of vertical edge 48 of corner element 24 as discussed above.

Second corner element 26 as shown FIG. 8 is replaced in the configuration of FIG. 9 with adjustable corner element 126. Adjustable corner element 126 appears in planform to be similar to the planform of second corner element 26. The arcuate planform of inner edge 127 and of tapered portion 128 is substantially the same as the arcuate planform of inner edge 58 and tapered portion 74 of second corner element 26. Adjustable corner element 126 has an adjustable segment 129 which is vertically adjustable with respect to fixed segment 130 of corner element 126. Adjustable segment 129 is contained entirely within and is bounded by fixed portion 130 of adjustable corner element 126 such that the entire length of left and right lateral edges 131 and 132, respectively, are fixed and abutted against other worksurface elements abutted thereto.

Figure 10:
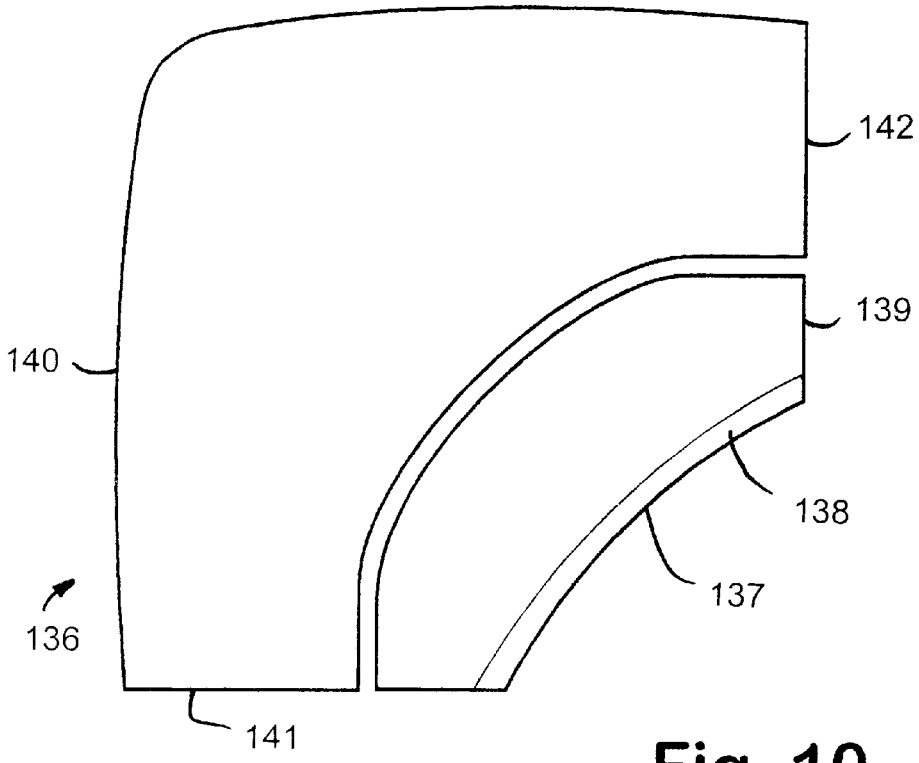
FIG. 10 is an alternate embodiment of a worksurface element having a vertically adjustable element.

FIG. 10 illustrates a second adjustable corner element 136 which is a variation of adjustable corner element 126, has an adjustable segment which extends from left lateral edge 141 to right lateral edge 142 of fixed segment 140. Vertically adjustable segment 139 has an inner edge 147 and tapered portion 138 which is identical to the elliptical planform of inner edge 58 and tapered portion 74 of second corner element 26.

Figure 11:
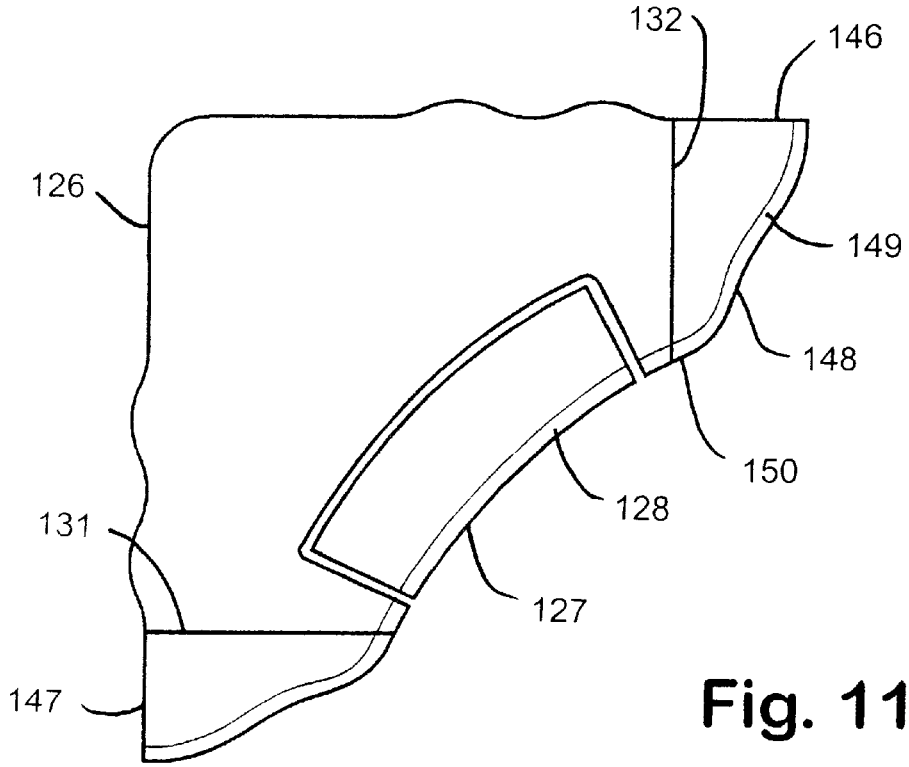
FIG. 11 shows worksurface elements according to the present invention incorporating accessory end surface elements.

FIG. 11 illustrates the use of worksurface elements from worksurface system 22 in a configuration outside of the typical rectilinearly enclosed work space module such as work space 20. In this type of application of worksurface system 22, a corner element such as adjustable corner element 126 can be utilized by itself and to which alternate end cap 146 is abutted to right lateral edge 132 and alternate end cap 147 (a mirror image of alternate end cap 146) is abutted to left lateral edge 141 of corner element 126. Alternate end cap 146 has an arcuately contoured outer edge 148 and a tapered portion 149 which are arcuately compatible with the arcuate profiles of other elements of the worksurface system 22. Edge 148 has an arcuate end segment 150 which is arcuately tangent to the elliptical planform of inner edge 127 and tapered portion 128 of adjustable corner element 126.

Figure 12:
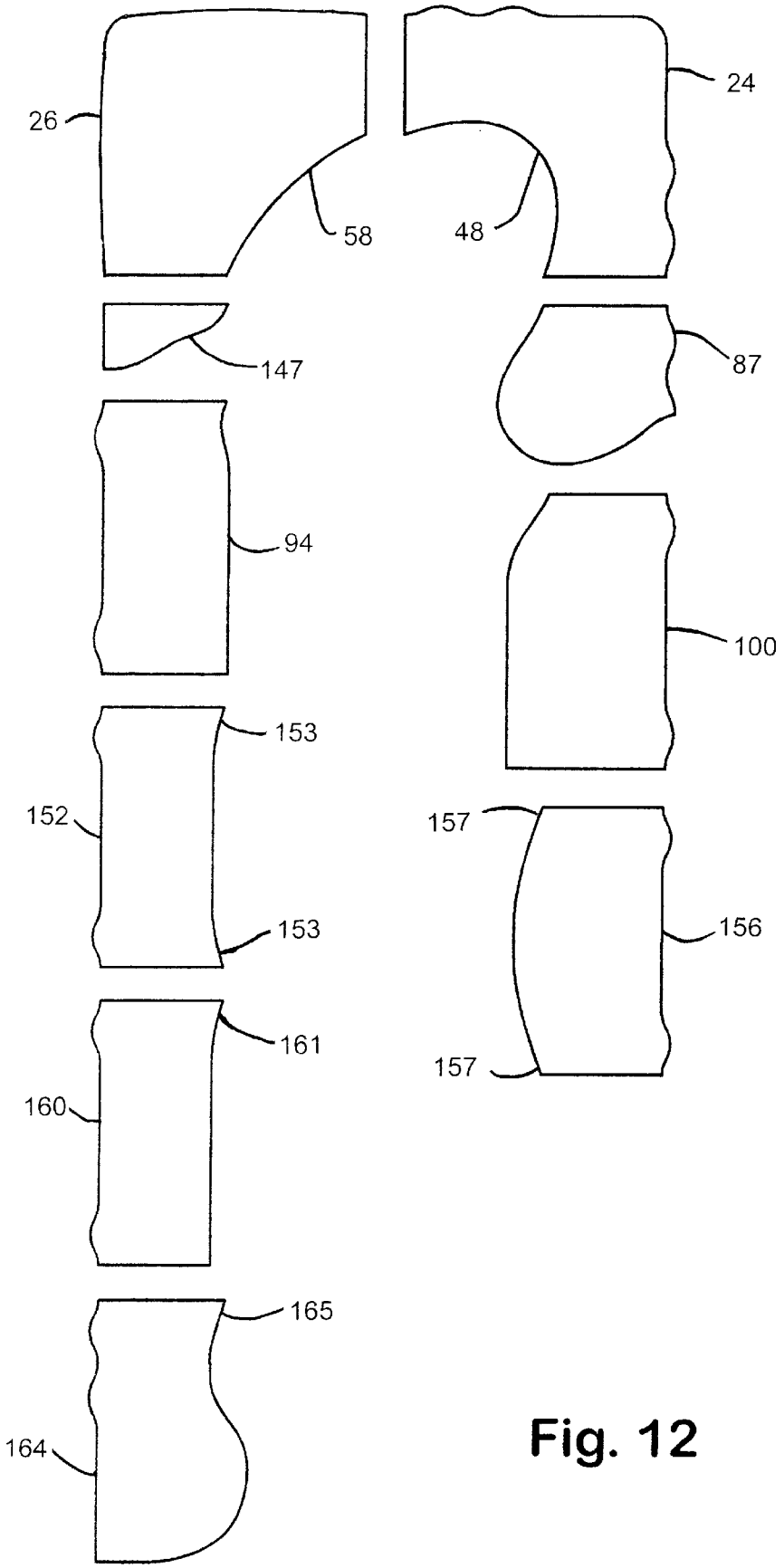
FIG. 12 illustrates two basic worksurface elements embodying the elliptical inner edge planform and an example of a variety of accessory worksurface elements which may be abutted thereto to construct a variety of work space configurations.

FIG. 12 illustrates the basic planform profile of first corner unit 24 and second corner unit 26 and shows below each a sample of typical accessory worksurface elements which may be combined therewith to populate and configure a work space area or module. Included are first and second linear elements 94 and 100 and wing element 87 as described above. Additionally, linear element 152 can be utilized to bridge between adjacent second corner units 26 wherein linear element 152 has at each end thereof an arcuate segment 153 which is arcuately tangent to the elliptical planform of either end of inner edge 58 of second corner unit 26. In like manner, crescent element 156 has an arcuate segment 157 at each end thereof which is arcuately tangent to inner edge 48 of first corner element 24. Worksurface elements 160 and 164 show alternative planforms wherein each has an arcuate segment 161 and 165, respectively, which are arcuately tangent to inner edge 58 of second corner unit 26 for abutment thereto.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention which is defined by the following claims as interpreted according to the principles of patent law, including the Doctrine of Equivalents.

The invention claimed is:

1. A system of worksurfaces for workstations and the like comprising:

at least first and second individual worksurfaces of a predefined thickness which are adapted to be supported in a generally horizontal orientation at a substantially common height, and each having a top surface defining at least one outer edge and wherein each said first and second individual worksurfaces define about a perimeter at least a first and second inner edge respectively, and configured to accommodate a user thereby, and lateral edges shaped to abut one another when said first and second worksurfaces are positioned adjacent each other; and further wherein:

said first and second inner edges in plan are elliptically contoured wherein the ellipse defined by said inner edges is substantially coplanar with said worksurfaces and is aligned with a horizontal diagonal of the workstation thereby adapting the worksurfaces to particular intended uses;

said top surface of said first worksurface immediately adjacent said first inner edge is variably tapered in elevation to be deeply tapered in areas intended for frequent user interaction such that at least a portion of said inner edge has a height less than one-half said predefined thickness; and said top surface of said second worksurface immediately adjacent said second inner edge is variably tapered in elevation to be shallowly tapered in areas intended primarily for storage and minimal user interaction such that at least a portion of said inner edge has a height slightly less than said thickness, and further wherein a height of said first and said second inner edges at adjoining ends is substantially equal.

2. A system of worksurfaces as set forth in claim 1, wherein:

said inner edge of said first worksurface defines in plan a first segment of an ellipse, said first segment centered about an end of a major axis of said ellipse.

3. A system of worksurfaces as set forth in claim 2, wherein:

said inner edge of said second worksurface defines in plan a second segment of an ellipse, said second segment centered about an end of a minor axis of said ellipse.

4. A system of worksurfaces as set forth in claim 3, wherein:

said major axis of said ellipse and said minor axis of said ellipse have a ratio of approximately 1.6:1.

5. A system of worksurfaces as set forth in claim 3, wherein:

said major axis of said ellipse is oriented substantially at a 45° angle to said at least one outer edge of said first worksurface.

6. A system of worksurfaces as set forth in claim 3, further including:

at least a third worksurface laterally adjacent either said first or said second worksurface, said third worksurface having an inner edge defining in plan in combination with said inner edges of said first and said second worksurfaces a substantially continuous inner edge.

7. A system of worksurfaces for workstations and the like comprising:

at least first and second individual worksurfaces adapted to be supported in a generally horizontal orientation at a substantially common height, and each having a top surface defining at least one outer edge and wherein each said first and second individual worksurfaces define about a perimeter at least a first and second concave inner edge respectively, and configured to accommodate a user thereby, and lateral edges shaped to abut one another when said first and second worksurfaces are positioned adjacent each other; and further wherein:

said first inner edge of said first worksurface adjacent to and in combination with at least a portion of said second inner edge of said second worksurface define in plan at least a portion of an ellipse; and wherein said inner edge of said first worksurface defines a first quadrant of said ellipse and said inner edge of said second worksurface defines a different but adjacent second quadrant of said ellipse.

8. A system of worksurfaces as set forth in claim 7, wherein:

said first quadrant of said ellipse is centered about an end of a major axis of said ellipse.

9. A system of worksurfaces as set forth in claim 8, wherein:

said second quadrant of said ellipse is centered about an end of a minor axis of said ellipse.

10. A system of worksurfaces as set forth in claim 9, wherein:

said major axis of said ellipse and said minor axis of said ellipse have a ratio of approximately 1.6:1.

11. A system of worksurfaces as set forth in claim 9, wherein:

said major axis of said ellipse is oriented substantially at a 45° angle to said at least one outer edge of said first worksurface.

12. A system of worksurfaces as set forth in claim 9, further including:

at least a third worksurface laterally adjacent either said first or said second worksurface, said third worksurface having an inner edge defining in plan in combination with said inner edges of said first and said second worksurfaces a substantially continuous inner edge.

13. A system of worksurfaces as set forth in claim 9, wherein:

said major axes of said ellipses are oriented substantially at a 45° angle to said at least one outer edge of said first worksurface.

14. A system of worksurfaces as set forth in claim 7, wherein:

said first worksurface has a tapered portion adjacent said inner edge, said tapered portion defined by said inner edge, at least a portion of each of said left and said right lateral edges, and by a boundary defined by an intersection of said tapered portion with said top surface.

15. A system of worksurfaces as set forth in claim 14, wherein:

said tapered portion has a non-uniform width as measured from said inner edge of said first worksurface to said boundary.

16. A system of worksurfaces as set forth in claim 15, wherein:

said tapered portion has a non-uniform thickness as measured from a bottom surface of said first worksurface to an upper surface of said tapered portion at said inner edge of said first worksurface.

17. A system of worksurfaces as set forth in claim 16, wherein:

said non-uniform thickness varies inversely proportional to said non-uniform width.

18. A system of worksurfaces as set forth in claim 17, wherein:

said inner edge of said first worksurface adjacent to and in combination with at least a portion of said inner edge of said second worksurface define in plan a segment of a first ellipse.

19. A system of worksurfaces as set forth in claim 18, wherein:

said boundary defines in plan a segment of a second ellipse.

20. A system of worksurfaces as set forth in claim 19, wherein:

said second ellipse is larger than said first ellipse.

21. A system of worksurfaces as set forth in claim 20, wherein:

said first ellipse and said second ellipse are concentric.

22. A system of worksurfaces as set forth in claim 21, wherein:

said inner edge of said first worksurface and said boundary define in plan a first segment of said first ellipse and a first segment of said second ellipse, each of said first elliptical segments centered about a major axis of said first and said second ellipse.

23. A system of worksurfaces as set forth in claim 22, wherein:

said second worksurface has a tapered portion adjacent said inner edge, said tapered portion defined by said inner edge, at least a portion of each of said left and said right lateral edges, and by a boundary defined by an intersection of said tapered portion with said top surface.

24. A system of worksurfaces as set forth in claim 23, wherein:

said tapered portion of said second worksurface has a non-uniform width as measured from said inner edge of said second worksurface to said boundary.

25. A system of worksurfaces as set forth in claim 24, wherein:

said tapered portion of said second worksurface has a non-uniform thickness as measured from a bottom surface of said second worksurface to an upper surface of said tapered portion at said inner edge of said second worksurface.

26. A system of worksurfaces as set forth in claim 25, wherein:

said inner edge of said second worksurface and said boundary of said second worksurface define in plan a second segment of said first ellipse and a second segment of said second ellipse, said second segments centered about a minor axis of said first and said second ellipses.

27. A system of worksurfaces as set forth in claim 26, wherein:

said major axis said minor axis of said first ellipse have a ratio of approximately 1.6:1, and said major axis and said minor axis of said second ellipse have a ratio of approximately 1.6:1.

28. A system of worksurfaces for workstations and the like comprising:

at least first and second individual worksurfaces adapted to be supported in a generally horizontal orientation at a substantially common height, and each having a top surface with at least one outer edge and wherein each said first and second individual worksurfaces define about a perimeter at least a first and second inner edge respectively and configured to accommodate a user thereby, and lateral edges shaped to abut one another when said first and second worksurfaces are positioned adjacent each other; and a non-uniform tapered portion adjacent said first and second inner edges wherein said tapered portion is defined by an upper boundary of said first and second inner edges, at least a portion of said lateral edges, and by an arcuately concave boundary defined by an intersection of said tapered portion with each said top surface.

29. A system of worksurfaces as set forth in claim 28, wherein:

said tapered portion of said first worksurface has a varying width as measured from said inner edge of said first worksurface to said boundary.

30. A system of worksurfaces as set forth in claim 29, wherein:

said tapered portion of said first worksurface has a non-uniform thickness as measured from a bottom surface of said first worksurface to an upper surface of said tapered portion at said inner edge of said first worksurface.

31. A system of worksurfaces as set forth in claim 30, wherein:

said non-uniform thickness varies inversely proportional to said non-uniform width.

32. A system of worksurfaces as set forth in claim 31, wherein:

said boundary of said first worksurface defines in plan a first segment of an ellipse.

33. A system of worksurfaces as set forth in claim 32, wherein:

said first segment of said ellipse is centered about a major axis of said ellipse.

34. A system of worksurfaces as set forth in claim 33, wherein:

said tapered portion of a second worksurface of said at least two worksurfaces has a non-uniform width as measured from said inner edge of said second worksurface to said boundary.

35. A system of worksurfaces as set forth in claim 34, wherein:

said tapered portion of said second worksurface has a non-uniform thickness as measured from said bottom surface of said second worksurface to an upper surface of said tapered portion at said inner edge of said second worksurface.

36. A system of worksurfaces as set forth in claim 35, wherein:

said boundary of said second worksurface defines in plan a second segment of said ellipse.

37. A system of worksurfaces as set forth in claim 32, wherein:

said second segment of said ellipse is centered about a minor axis of said ellipse.

* * * * *